US006986171B1

(12) United States Patent
Perrin

(10) Patent No.: US 6,986,171 B1
(45) Date of Patent: Jan. 17, 2006

(54) LAVATORY SYSTEM

(75) Inventor: Timothy E. Perrin, Hartford, WI (US)

(73) Assignee: Bradley Fixtures Corporation, Mequon, WI (US)

( * ) Notice: Subject to any disclaimer, the term of this patent is extended or adjusted under 35 U.S.C. 154(b) by 0 days.

(21) Appl. No.: 10/423,814

(22) Filed: Apr. 25, 2003

Related U.S. Application Data

(60) Provisional application No. 60/376,168, filed on Apr. 26, 2002.

(51) Int. Cl.
*E03D 11/12* (2006.01)

(52) U.S. Cl. ..... 4/312; 4/300.2; 4/664

(58) Field of Classification Search ..... 4/300.2, 4/307, 312, 664, 665
See application file for complete search history.

(56) References Cited

U.S. PATENT DOCUMENTS

| | | | | |
|---|---|---|---|---|
| 37,896 A | | 3/1863 | Bissicks | |
| 68,802 A | | 9/1867 | Staples | |
| 200,480 A | | 2/1878 | Rivera | |
| 345,890 A | | 7/1886 | Farson | |
| 426,287 A | | 4/1890 | Larkin | |
| 456,678 A | * | 7/1891 | O'Brien | 4/312 |
| 882,760 A | | 3/1908 | Hubert | |
| 968,541 A | | 8/1910 | Connelly | |
| 1,180,140 A | | 4/1916 | Godoy | |
| 1,225,914 A | | 5/1917 | Wood | |
| 1,409,330 A | | 3/1922 | Aper | |
| 1,763,209 A | | 6/1930 | Ayers et al. | |
| 1,763,277 A | | 6/1930 | Tilden | |
| 1,793,815 A | | 2/1931 | McCann | |
| 1,841,143 A | | 1/1932 | McCann | |
| D90,837 S | | 10/1933 | Davison | |
| D97,839 S | | 12/1935 | Callahan | |
| 2,184,722 A | | 12/1939 | McLoughlin | |
| 2,188,562 A | * | 1/1940 | Andersen et al. | 4/312 |
| 2,198,605 A | | 4/1940 | Faber | |
| 2,267,618 A | | 12/1941 | Shapiro | |
| D132,476 S | | 5/1942 | Martin | |

(Continued)

FOREIGN PATENT DOCUMENTS

JP 54-144028 11/1979

(Continued)

OTHER PUBLICATIONS

Bradley Corporation—Product Information, web page print-out, Lav Care 700/750 Series, 3 pgs.*

(Continued)

*Primary Examiner*—Robert M. Fetsuga
(74) *Attorney, Agent, or Firm*—Foley & Lardner LLP

(57) ABSTRACT

A lavatory system is disclosed. The lavatory system comprises a base, a commode having a front and a rear coupled to the base and movable relative to the base between a deployed position and a stowed position, a first projection engaged between the base and the commode, and a first member adjacent the front and coupled to the projection so that the commode can be disengaged from the base. An apparatus for a lavatory system is also disclosed. The lavatory system has a commode with a front and a rear coupled to a base and configured to pivot between a deployed position and a stowed position, and a detent engaged between the commode and the base. The apparatus comprises a member adjacent the front of the commode and operatively coupled to the detent, the member configured to disengage the commode from the base by actuation of the detent so that the commode can be moved from the deployed position toward the stowed position.

16 Claims, 7 Drawing Sheets

U.S. PATENT DOCUMENTS

| | | | |
|---|---|---|---|
| D144,811 | S | 5/1946 | Smith |
| 2,434,889 | A | 1/1948 | Sacia |
| 2,443,214 | A | 6/1948 | Williams |
| D162,619 | S | 3/1951 | Blashfield |
| 2,558,443 | A | 6/1951 | Krenov |
| 2,611,134 | A | 9/1952 | Jarrett et al. |
| 2,750,599 | A | 6/1956 | Colonna |
| 2,860,348 | A | 11/1958 | McClenahan |
| 2,879,519 | A | 3/1959 | Mueller |
| 2,907,048 | A | 10/1959 | Gould |
| D190,795 | S | 7/1961 | Rancorn |
| D190,988 | S | 8/1961 | Radcliff et al. |
| 2,994,887 | A | 8/1961 | Thornton |
| 3,015,110 | A | 1/1962 | Treand |
| 3,047,106 | A | 7/1962 | Callahan |
| D197,944 | S | 4/1964 | Tiller |
| D197,945 | S | 4/1964 | Tiller et al. |
| D197,946 | S | 4/1964 | Tiller |
| D197,947 | S | 4/1964 | Tiller et al. |
| D198,256 | S | 5/1964 | Tiller et al. |
| D199,048 | S | 9/1964 | Tiller |
| 3,149,346 | A | 9/1964 | Springer |
| D203,253 | S | 12/1965 | de Kanter |
| D206,740 | S | 1/1967 | Hoeffken |
| 3,419,911 | A | 1/1969 | Wood |
| 3,436,764 | A | 4/1969 | Colonna |
| 3,520,005 | A | 7/1970 | Downes |
| 3,593,346 | A | 7/1971 | Katona |
| 3,646,617 | A | 3/1972 | Heald |
| 3,719,959 | A | 3/1973 | Ekstrom |
| 3,780,383 | A | 12/1973 | Katona |
| 3,829,906 | A | 8/1974 | McPhee |
| D233,149 | S | 10/1974 | Campbell |
| 3,881,200 | A | 5/1975 | Maier-Gerber |
| 3,905,051 | A | 9/1975 | Gozdziewski |
| 4,030,145 | A | 6/1977 | Rowan |
| 4,045,827 | A | 9/1977 | Morris et al. |
| 4,060,859 | A | 12/1977 | Anderson |
| 4,089,073 | A | 5/1978 | Campbell |
| D251,065 | S | 2/1979 | Campbell |
| 4,138,748 | A | 2/1979 | Zielinski |
| 4,142,255 | A | 3/1979 | Togni |
| 4,142,256 | A | 3/1979 | Campbell |
| D252,038 | S | 6/1979 | Morris et al. |
| 4,177,527 | A | 12/1979 | Uhlig |
| D256,153 | S | 7/1980 | Juaire et al. |
| 4,221,441 | A | 9/1980 | Bain |
| D266,268 | S | 9/1982 | Adamcik |
| 4,366,584 | A | 1/1983 | Mchuma |
| 4,368,551 | A | 1/1983 | Cummings |
| 4,396,240 | A | 8/1983 | Henson |
| D281,714 | S | 12/1985 | Morris et al. |
| 4,645,145 | A | 2/1987 | Alie |
| D288,709 | S | 3/1987 | Campbell |
| D288,710 | S | 3/1987 | Campbell |
| 4,653,128 | A | 3/1987 | Canalizo |
| 4,680,817 | A | 7/1987 | Sloan et al. |
| 4,944,047 | A | 7/1990 | Gagliano |
| 4,970,732 | A | 11/1990 | Deng |
| D331,621 | S | 12/1992 | Tapolcai |
| D352,096 | S | 11/1994 | Tagg |
| D394,495 | S | 5/1998 | Hauser, II |
| 5,765,237 | A | 6/1998 | Okamoto et al. |
| 5,852,833 | A | 12/1998 | Gregoire |
| 5,960,483 | A | 10/1999 | Delzer et al. |
| D424,176 | S | 5/2000 | Wheeler, III |
| 6,094,756 | A | 8/2000 | Carter |
| 6,145,351 | A * | 11/2000 | Levenson ..... 70/93 |

FOREIGN PATENT DOCUMENTS

| | | |
|---|---|---|
| JP | 2-274931 | 11/1990 |

OTHER PUBLICATIONS

The American Heritage Dictionary, pp. 387 and 911.*

Bedside Lavatory Unit Brochure and Specifications; bearing a designation "© 2000 Modular Services Co." (4 pages).

Care-Ware Patient Health Systems Brochure and Specifications; Acorn Engineering Company (20 pages).

ADA Vetalette ™ Product Decription; bearing a designation "Jul., 1999"; Whitehall Manufacturing (1 page).

Hygeia Lav Standard Co. Module 100 Product Description & Specification (2 pages).

Care-Ware®—Versalette™ Bedside Patient Care Units; Model 4040 Series Product Description by Whitehall Manufacturing, a Division of Acorn Engineering; bearing a designation "Jun. 25, 2002" http://www.whitehallmfg.com/care_ware/versalette.html (2 pages).

BLU-S by Modular Services Company Product Description; bearing a designation "Mar 17, 2003"; http://headwalls.com/blu-s.html (2 pages).

Bradley Lavatory Systems Patient Care Application Guidelines; bearing a designation "Jun. 20, 2000"; http://www.bradleycorp.com (7 pages).

Bradley Security Fixtures; News Release; Bradley Corporation; bearing a designation "Copyright ©1999 Bradley Corporation"; shttp://www.bradleycorp.com (17 pages).

Installation and Maintenance Instructions—Bradley's LavCare™ 2000 Patient Care Module with Terreon® Lavatory Top; 215-1317; bearing a designation "EN98-1014" (8 pages).

Bradley Corporation, Photographs of Water Closet for Bradley LavCare™ 700 Series and 750 Series, believed to be commercially available prior to Apr. 26, 2002; (3 sheets).

* cited by examiner

LAVATORY SYSTEM

CROSS-REFERENCE TO RELATED PATENT APPLICATIONS

The present invention claims priority under 35 U.S.C. § 119 to U.S. Provisional Patent Application No. 60/376,168 titled "LAVATORY SYSTEM" filed Apr. 26, 2002, the full disclosure of which is hereby incorporated herein by reference.

BACKGROUND OF THE INVENTION

The present inventions relate to a lavatory system. The present inventions more specifically relate to a lavatory system including a toilet and a mechanism movable between a stowed position and a deployed position.

It is generally known to provide for a lavatory system for use in a home, commercial or institutional facility such as a medical care facility or the like. Known arrangements for lavatory systems may provide (in a compact design) a base (e.g. cabinet), a sink, water closet (i.e., with toilet), countertop, and may be configured with one or more accessories such as a bedpan washer, dialysis equipment, etc. Such lavatory systems may be configured to provide a movable toilet (relative to the base) that can be deployed and allow access to (or use of) the toilet. Such lavatory systems also may be configured to be retained or locked in the deployed position and then "unlocked" or disengaged to allow movement to its stowed position. However, such known arrangements for lavatory systems may present inconvenient or disadvantageous features in application or use, such as relative difficulty to use (e.g., effort and vigilance to stow or cover toilet), or to clean (or keep clean), or to maintain the mechanism that disengages the toilet from its locked position.

Accordingly, it would be advantageous to provide a lavatory system that has a compact design and a movable toilet. It would also be advantageous to provide a lavatory system with a mechanism for disengaging the toilet relative to the base that is more convenient to use. It would further be advantageous to provide a lavatory system that is configured to provide for a disengagement mechanism that does not require the use of the user's hands or their placement near the toilet itself. It would further be advantageous to provide a lavatory system that is a bed pan washer that has a more efficient configuration for the plumbing. It would be desirable to provide for a lavatory system having one or more of these or other advantageous features.

SUMMARY OF THE INVENTION

The present invention relates to a lavatory system comprising a base, a commode having a front and a rear coupled to the base and movable relative to the base between a deployed position and a stowed position, a first projection engaged between the base and the commode, and a first member adjacent the front and coupled to the projection so that the commode can be disengaged from the base.

The present invention further relates to a lavatory system comprising a base, a commode having a front and a rear coupled to the base and movable relative to the base between a deployed position and a stowed position, and an assembly configured to releasably couple the commode to the base in the deployed position, the assembly including a first member adjacent the front and operable so that the commode can be disengaged from the base.

The present invention further relates to a commode assembly comprising a base, a commode having a front and a rear coupled to the base and movable relative to the base between a deployed position and a stowed position, a first member projecting from the front of the commode, and a second member engaged between the commode and the base and actuated by the first member so that the commode can be moved between the deployed position and the stowed position.

The present invention further relates to an apparatus for a lavatory system having a commode with a front and a rear coupled to a base and configured to pivot between a deployed position and a stowed position, and a detent engaged between the commode and the base. The apparatus comprises a member adjacent the front of the commode and operatively coupled to the detent, the member configured to disengage the commode from the base by actuation of the detent so that the commode can be moved from the deployed position toward the stowed position.

The present invention further relates to an improvement to a lavatory system having a commode with a front and a rear coupled to a base and configured to move between a deployed position and a stowed position, and a detent engaged between the commode and the base. The improvement comprises a member coupled to the detent and extending adjacent the front of the commode so that actuation of the member disengages the commode from the base.

DETAILED DESCRIPTION OF THE PREFERRED EMBODIMENTS

Figure 1:
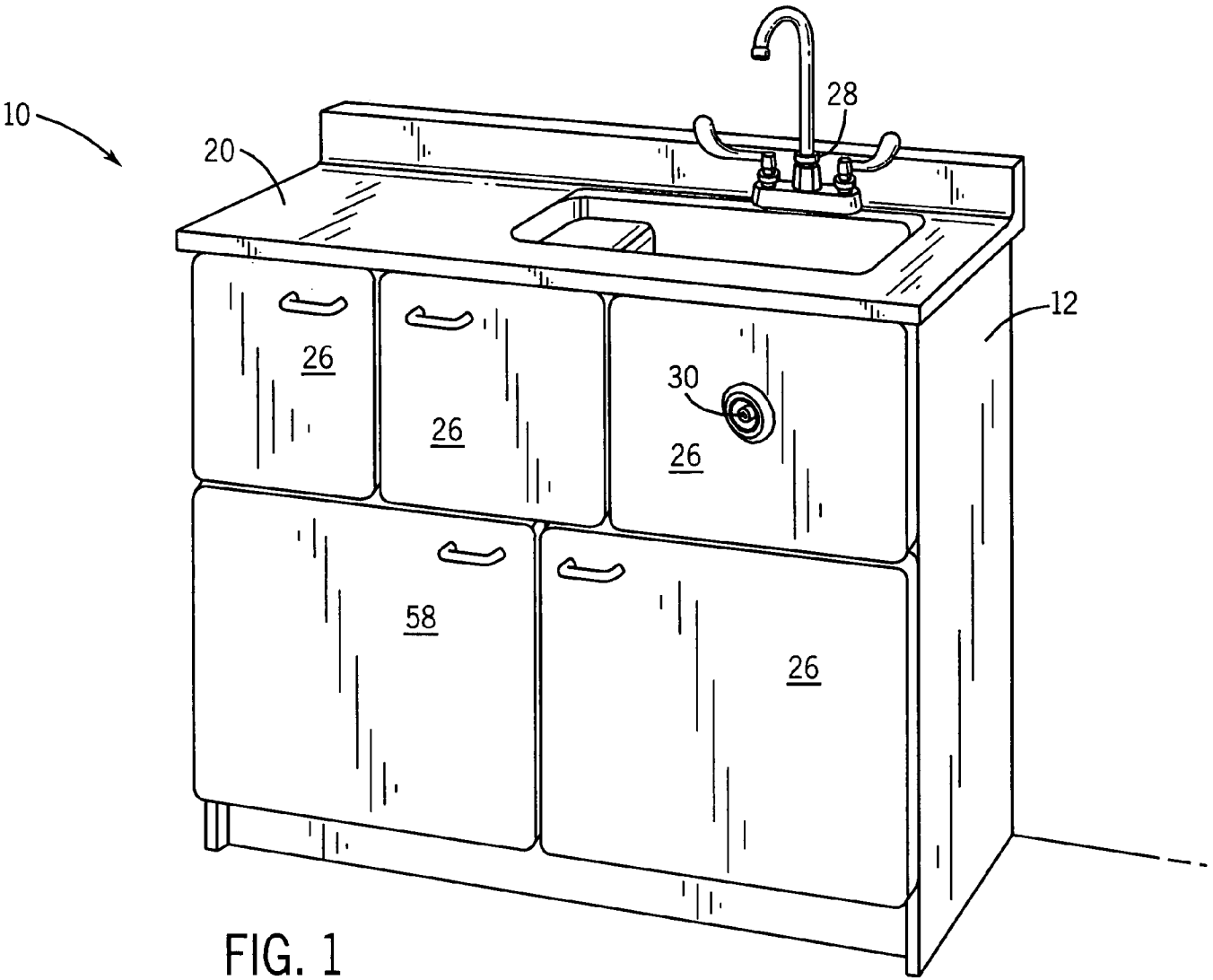
FIG. 1 is a perspective view of a lavatory system according to a preferred embodiment.
Figure 2:
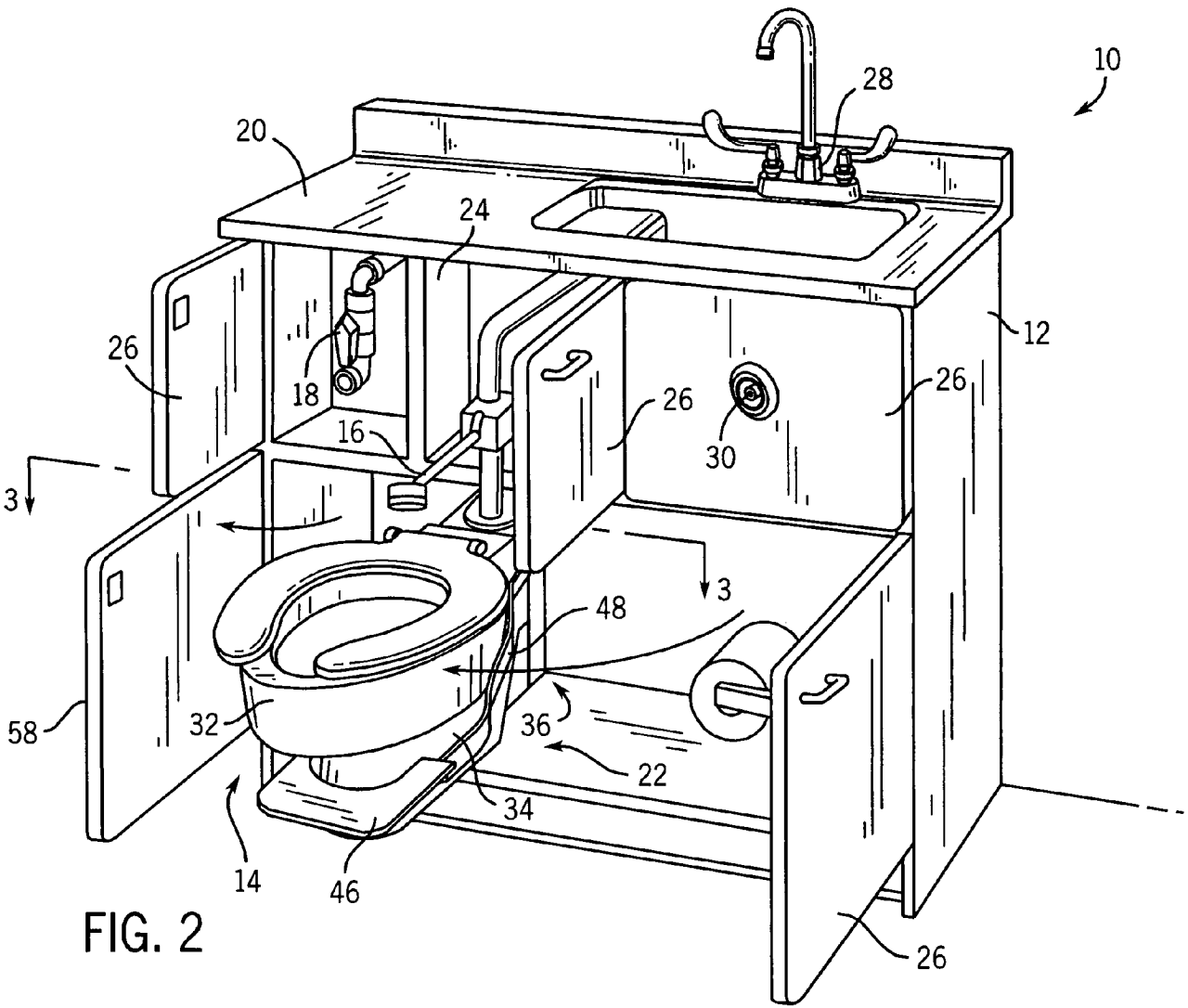
FIG. 2 is a perspective view of the lavatory system of FIG. 1.

The FIGURES disclose a lavatory system 10 according to a preferred embodiment. Lavatory system 10 includes a base shown as a cabinet 12, a receptacle shown as a commode 14, one or more accessories (e.g., bedpan washer 16, dialysis apparatus 18, etc.), a countertop 20 mounted to cabinet 12, and a release assembly or mechanism 22.

Cabinet 12 includes a structural frame 24 and a plurality of panels 26 mounted on frame 24 or pivotally coupled to the base shown as cabinet 12. Frame 24 is configured to support cabinet 12 and includes a plurality of support members (e.g., horizontal braces or members and vertical braces or members). The support members are connected by any of a variety of fabrication methods such as fasteners, welding, riveting, etc. A plumbing system for lavatory system 10 is generally enclosed by cabinet 12 and is in communication with commode 14, a faucet assembly 28, and the accessories. A valve interface (shown as a flush button 30) is mounted to cabinet 12 and configured to open and shut a flush valve.

Commode 14 is configured to move between a stowed position and a deployed position. According to a preferred embodiment, commode 14 pivots or swivels between the stowed position (where it is located substantially or entirely within cabinet 12) and the deployed position (where it is generally perpendicular to its stowed position or from the front of the cabinet 12). Commode 14 includes a bowl or receptacle 32 and a support 34 (e.g., frame, housing, shroud, cover, etc. that supports receptacle 32 and couples receptacle 32 to a base 36). According to an alternative embodiment, the commode may be configured for any of a variety of movements and positions.

Commode 14 is operatively coupled to base 36 (shown to comprise a support 38 and a pedestal 40). According to a preferred embodiment, a mounting portion 43 of commode 14 is pivotally coupled to support 38 so that commode 14 pivots about an axis 39 between the deployed position and the stowed position. A top bracket 41 couples (e.g., secures) commode 14 to pedestal 40. According to a particularly preferred embodiment, commode 14 is mounted to base 36 as provided in patient care lavatories commercially available from Bradley Corporation as Bradley LavCare™ 700 Series or the Bradley LavCare™ 750 Series. According to an alternative embodiment, the commode may be coupled to the support in any of a variety of ways to provide any of a variety of movements (e.g., pivoting, rotating, swiveling, translating, etc.).

According to an exemplary embodiment, commode 14 has a rear and a front and is configured to be retained in place in a stopped position (e.g., in the deployed position, stowed position; and/or at any of a variety of positions). According to a preferred embodiment, commode 14 is retained in place at the deployed position and released to move (e.g., pivot, swivel, etc.) towards the stowed position upon operation of release mechanism 22.

Release apparatus or mechanism 22 includes a foot-operated input device (e.g., a lever member or apparatus) that can be pivoted to disengage (e.g., withdraw) a retaining device or member shown as comprising pin or detent 44 from base 36. According to a preferred embodiment, pivotal movement of the input device or lever provides (e.g., causes, is converted to, etc.) translational or translating movement of projection or detent 44.

Figure 4:
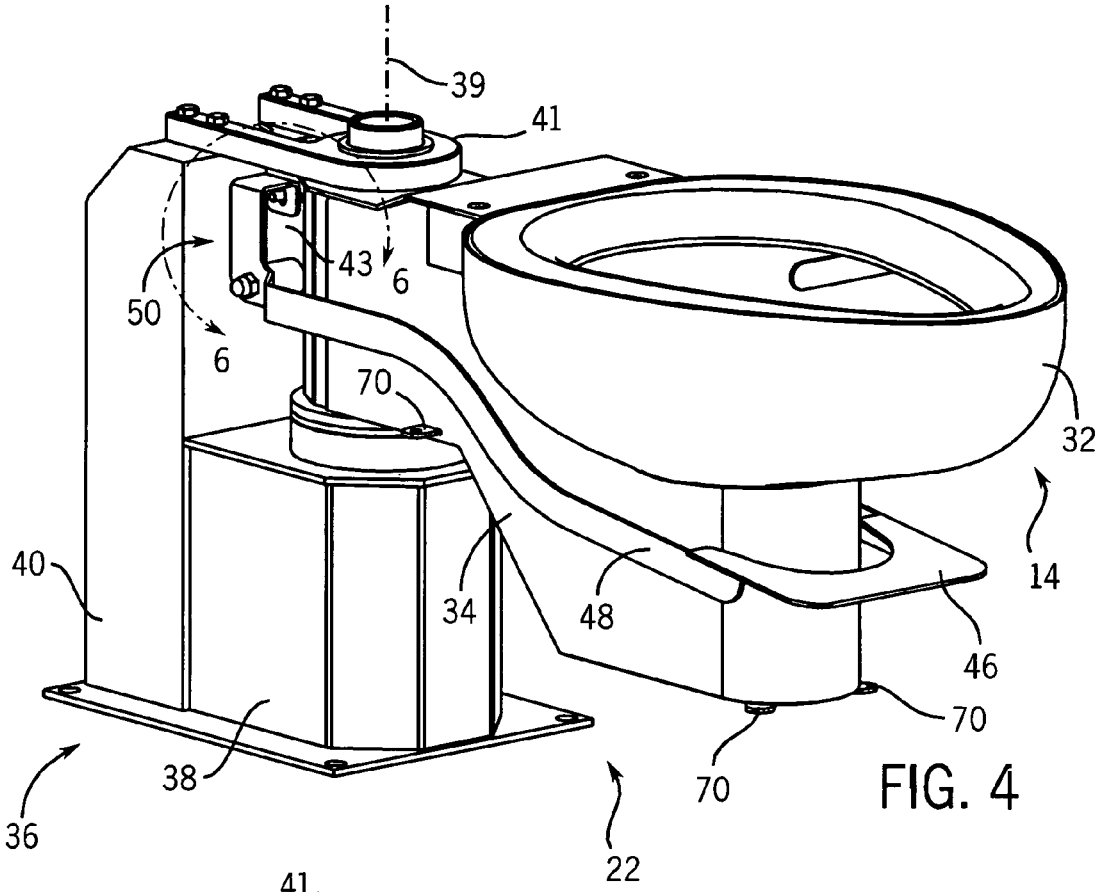
FIG. 4 is a perspective view of the commode assembly.

According to an exemplary embodiment, the input device or actuation member extends from (and adjacent to) the front of commode 14, and includes a pair of pivot arms 48 (e.g., rods, bars, members, etc.), a user interface 46 (e.g., at one end of arms 48), and a pivot interface 50 (e.g., at the opposite end of arms 48). As shown in FIG. 4, pivot arms 48 extend along the sides of commode 14 and user interface 46 (e.g., pedal) is adjacent the front of commode 14.

According to an exemplary embodiment, user interface 46 is a plate, panel, pedal, or other structure coupled to arms 48 (e.g., welded, bolted, joined, bonded, etc.). According to an alternative embodiment, the user interface may be integrally formed with arms 48 (e.g., cast, stamped, molded, etc.).

Figure 6:
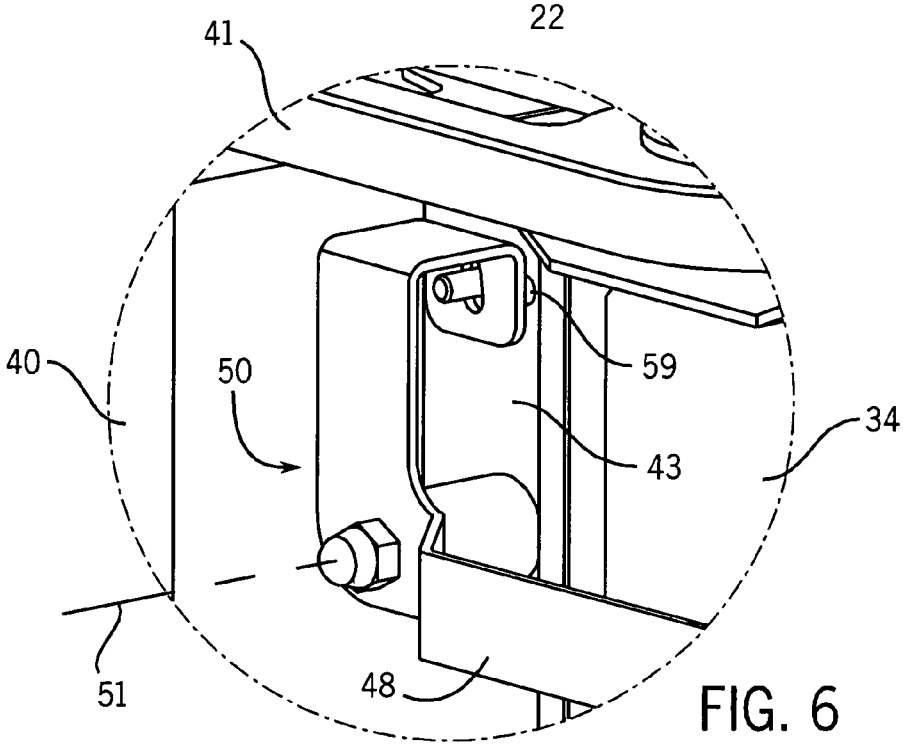
FIG. 6 is a fragmentary perspective view of a pivot portion of a release mechanism of the commode assembly of FIG. 4.
Figure 5:
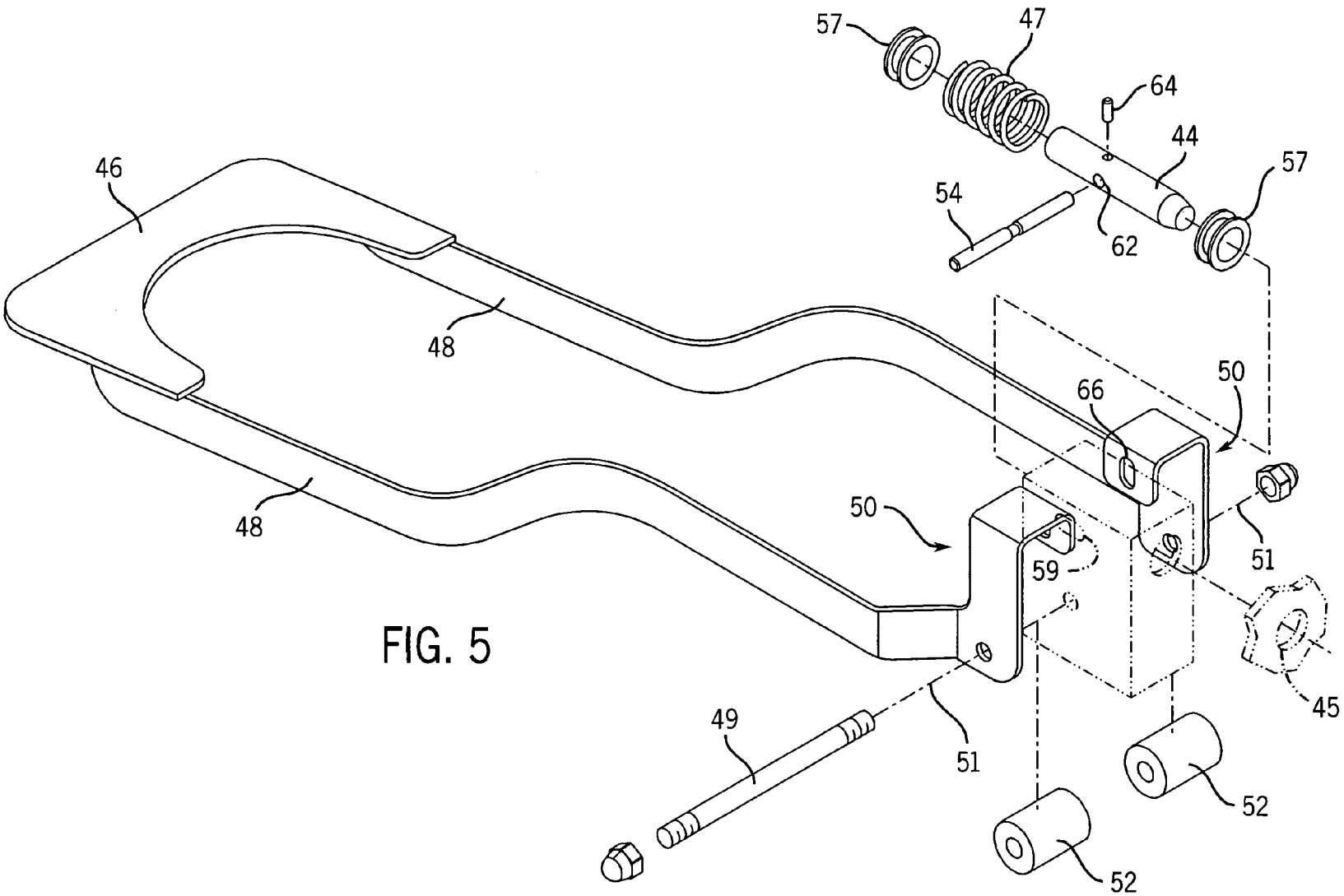
FIG. 5 is an exploded view of a release mechanism for the commode assembly of FIG. 4.
Figure 7:
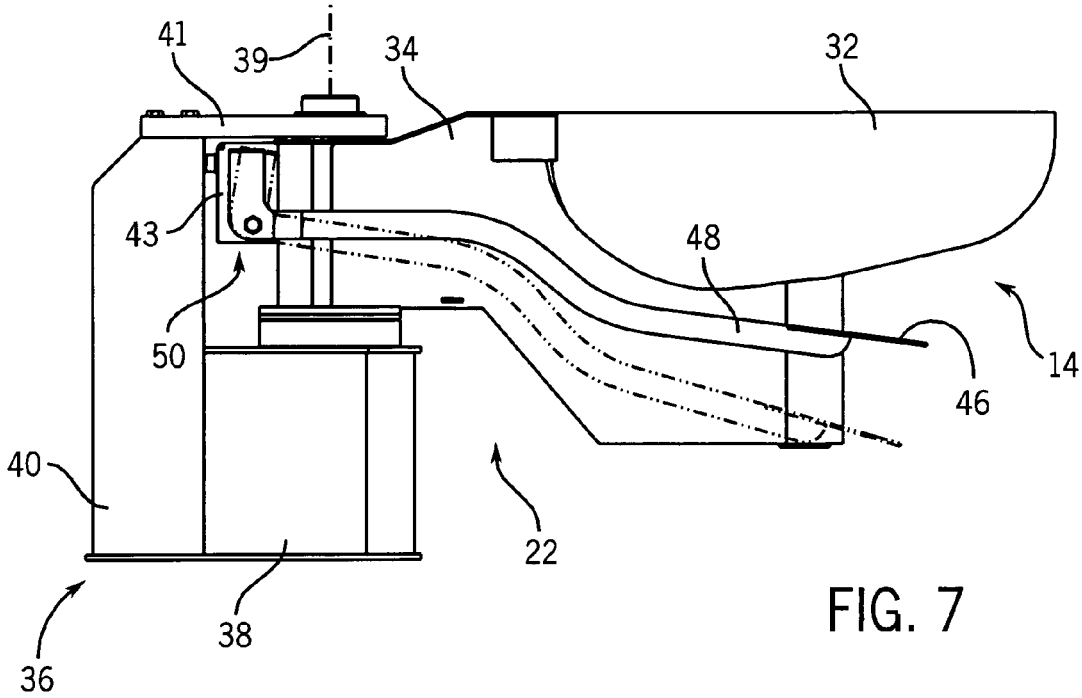
FIG. 7 is a side elevation view of the release mechanism being operated.
Figure 8:
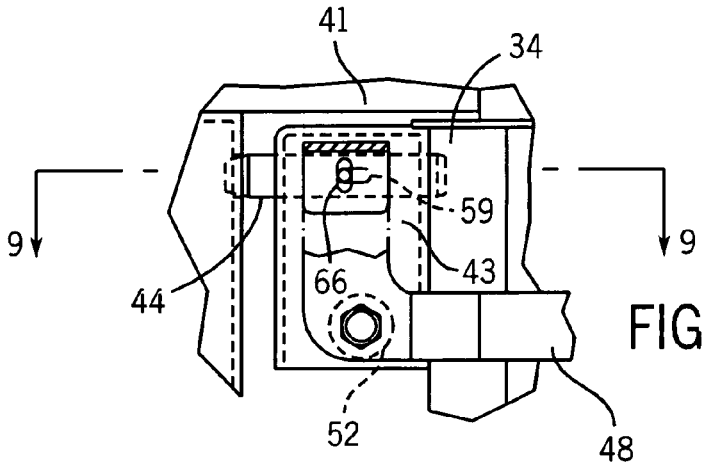
FIG. 8 is a fragmentary side elevation sectional view of the retaining device in the engaged position.
Figure 10:
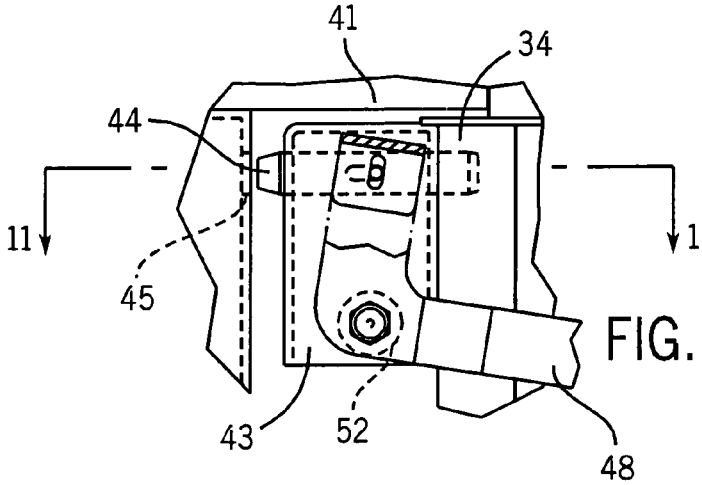
FIG. 10 is a fragmentary side elevation sectional view of the retaining device in the disengaged position.
Figure 9:
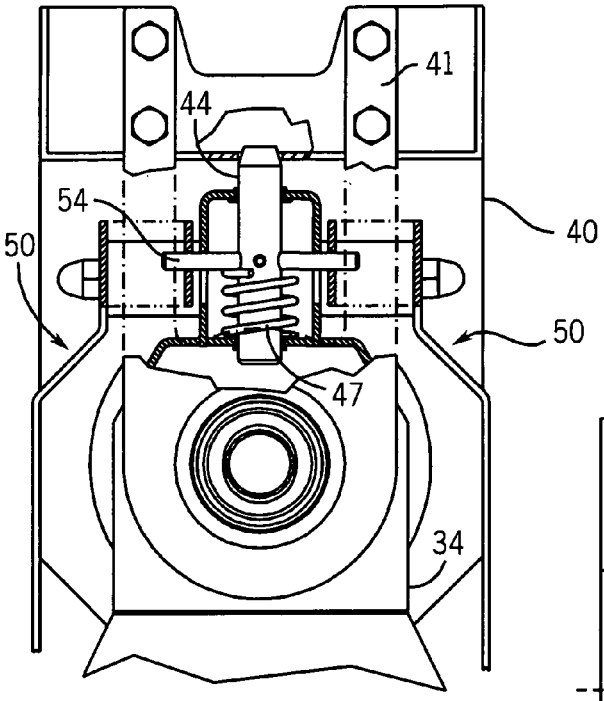
FIG. 9 is a fragmentary top plan sectional view of the retaining device in the engaged position.
Figure 11:
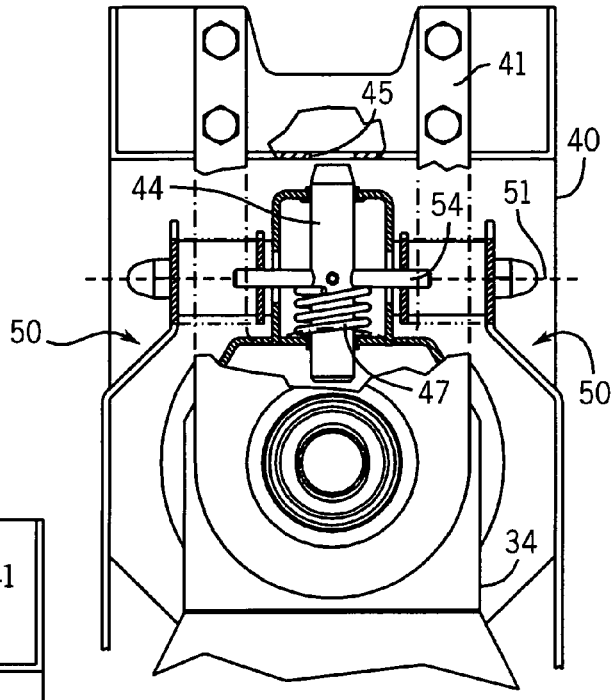
FIG. 11 is a fragmentary top plan sectional view of the retaining device in the disengaged position.
Figure 12:
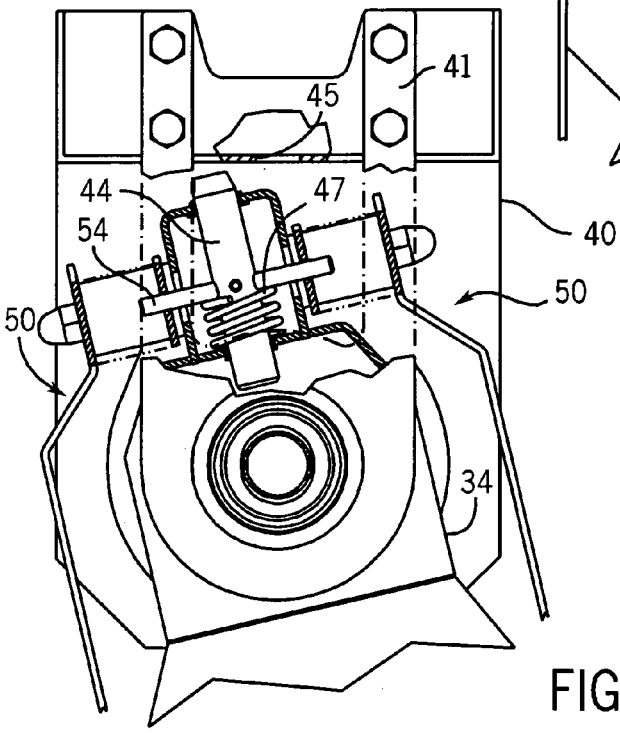
FIG. 12 is a fragmentary top plan sectional view of the retaining device disengaged from the base and partially pivoted between the deployed position and the stowed position.

Pivot interface 50 is configured to operatively couple user interface 46 of release mechanism 22 to base 36. Referring to FIG. 6, pivot interfaces 50 on arm 48 are coupled to mounting portion 43 of commode 14 by a pivot shaft 49. As such, the lever is configured to pivot about an axis 51 upon operation of user interface 46 to disengage release mechanism 22 so that commode 14 may be moved (pivoted, swiveled, etc.) from the deployed position to the stowed position. According to a preferred embodiment, pivot interface 50 is provided at the end portion of arms 48 configured as shown in FIG. 6 (i.e., pivot points disposed below and inward (toward user interface 46) relative to the portion that engages with pin 54). Pivot shaft 49 is disposed in a bushing 52 (e.g., a spacer, bearing, etc.) located between pivot interface 50 and mounting portion 43 of commode 14. According to a particularly preferred embodiment, nuts (e.g. acorn nuts, or the like) retain pivot interface 50 on pivot shaft 49.

Release mechanism 22 further includes a detent 44 (e.g., pin, shaft, catch, latch, stop member, rod, dowel, projection, etc.) and a slider member (shown as a pin 54) that coact to engage or isengage the commode 14 to or from the base 36. Detent 44 may be any of a variety of structures (e.g., pin, shaft, etc.) and is slidably mounted in mounting portion 43 of commode 14, preferably with bushings 57 (e.g., grommets, bearings, etc.).

Detent 44 extends or projects from mounting portion 43 to engage an aperture 45 in pedestal 40. According to a preferred embodiment, detent 44 is biased (e.g., with a spring 47) in an extended or projected position to extend from pivot portion to engage pedestal 40. When detent 44 engages pedestal 40, commode 14 is retained in the deployed position (e.g., secured, retained, locked, engaged, etc.). According to an alternative embodiment, the commode may be retained or inhibited from movement by any of a variety of devices, mechanisms, or the lock.

Pin 54 extends through a bore 62 in detent 44 and is retained in place by a fastener 64 (e.g., a pin, rod, dowel, bolt, set screw, etc.). Ends of pin 54 extend through mounting portion 43 of commode 14 and engage slots 66 in pivot interface 50 on pivot arms 48. Operation of the lever is pivot arms 48 about axis 51 so that both pivot interfaces 50 (i.e., arms 48) exert a force on pin 54 to slide it in a slot 59 on rear mounting portion 43 of commode 14. Sliding of pin 54 moves (e.g., slides) detent 44 between an extended position (where detent 44 is engaged with pedestal 40) and retracted position (where detent 44 is disengaged with pedestal 40) as the lever is operated or actuated.

According to a preferred embodiment, to move the commode 14 from the deployed position to the stowed position, the user operates pedal 46 (e.g., steps down with foot) to actuate release mechanism 22. Release mechanism 22 pivots about the pivot point so that pins 54 retract detent 44 thereby disengaging pedestal 40 and permitting commode 14 to be moved (e.g., pivoted or rotated). When detent 44 is disengaged from pedestal 40, commode 14 is free to pivot towards the stowed position. Commode 14 is moved from the deployed position to the stowed position by closing or pivoting a panel (shown as a door 58).

Figure 3:
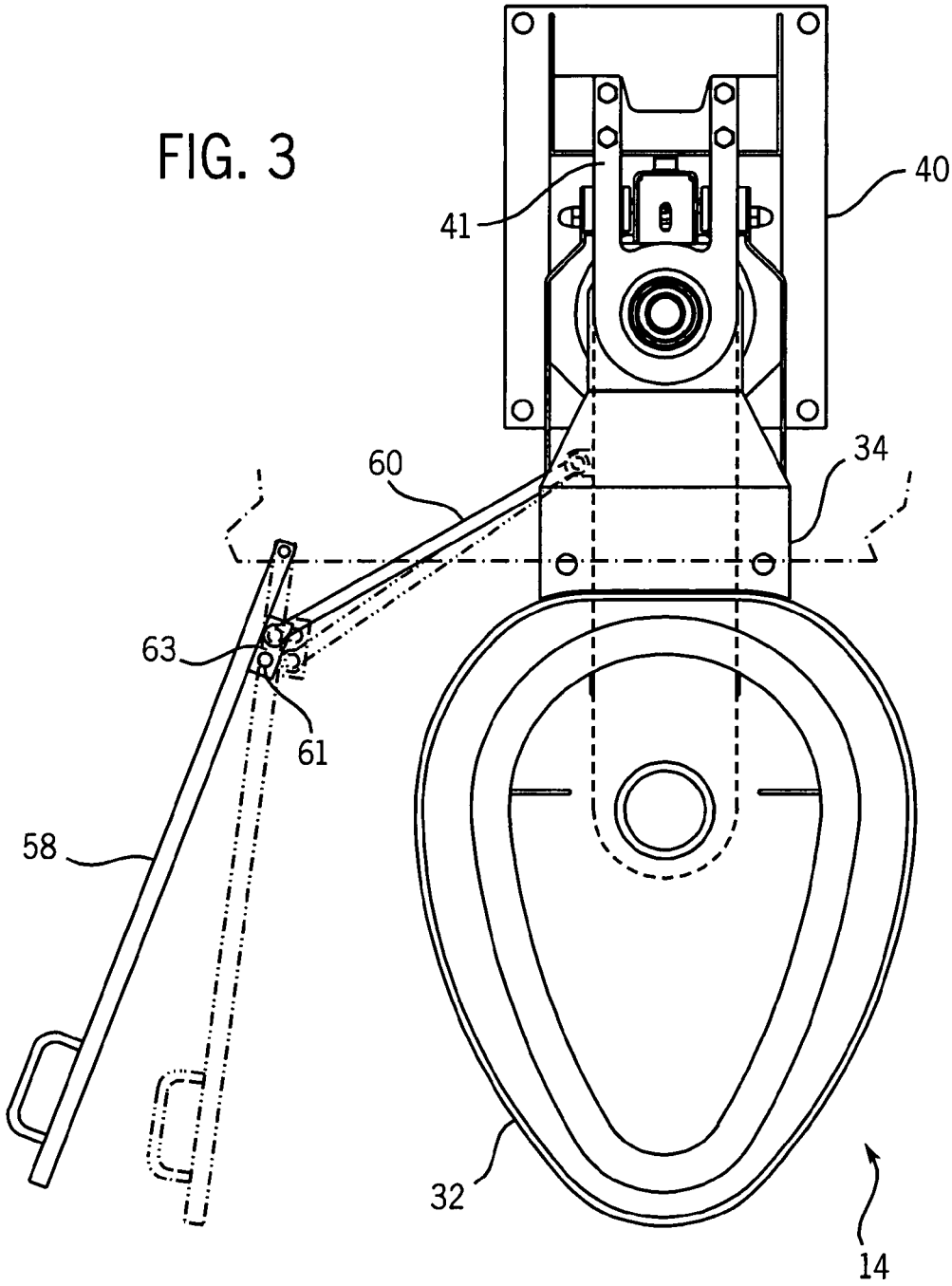
FIG. 3 is a fragmentary top plan view of a commode assembly according to a preferred embodiment.

A mechanism comprising a member or rod 60 transfers the closing movement of door 58 to pivoting movement of commode 14 (towards the stowed position). Rod 60 is configured to transfer closing of door 58 to "stowing movement" of toilet (e.g., pivoting movement). One end of each rod 60 is operatively coupled to door 58. The other end of rod 60 is coupled to commode 14. According to an alternative embodiment, any of a variety of members may be used to transfer movement of the door to the movement of the commode. According to a preferred embodiment shown in FIG. 3, rod 60 has a variety of mounting positions (shown as mounting apertures 61) on a bracket 63 on door 58 so that the position of door 58 when commode is in the deployed position is discretely selectable.

When commode 14 is moved from the stowed position to the deployed position, end of detent 44 slides along the surface of pedestal 40 until it becomes aligned with the aperture in pedestal 40, at which time, the spring urges detent 44 into the aperture to engage (e.g., "lock," secure, etc.) base 36 and retain commode 14 in the deployed position.

According to an exemplary embodiment, one or more projections 70 (stop members or tabs or members) are used to limit the pivotal movement of release mechanism 22. The range of pivotal motion of release mechanism 22 is limited to reduce or prevent over-pivoting of release mechanism 22, bending of pivot interface 50, full compression of spring, and/or to limit the force being exerted upon pivot interface 50. According to a preferred embodiment, projections 70 are coupled to support 34 and extend out from end of support 34. According to a particularly preferred embodiment, each projection 70 is an independent structure and is welded to bottom surface of support 34 to project away at about a 45 degree angle. According to alternative embodiments, support brackets may be configured to limit pivotal movement to any of a variety of angles between the backrest and the cover. According to an alternative embodiment, any of a variety of structural members may be used to inhibit movement of the release mechanism (e.g., to interfere with pedal, rods, brackets, etc.).

According to an alternative embodiment, a bracket (e.g., plate, U-channel, etc.) is coupled to at an end of support 34 between commode 14 and pedestal 40. A pair of fasteners are inserted through spacers 52 extending from pivot interface 50 and coupled to the pivot bracket, and a pair of shoulder bolts threadably engage nuts mounted (e.g., welded, etc.) to the inside surface of the pivot bracket. According to an alternative embodiment, the release mechanism may be operatively coupled to the lavatory system in any of a variety of ways configured to release commode from its engaged (e.g., locked, secured, etc.) position. According to an alternative embodiment, the release mechanism may be pivotally coupled to the lavatory unit in any of a variety of ways by any of a variety of pivot members or the like.

It is also important to note that the construction and arrangement of the elements of the lavatory system as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). Also, it is intended that the release mechanism be adaptable to a variety of lavatory systems to convert them from the conventional design to the novel embodiments of the present disclosure. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A lavatory system comprising:

a base;

a commode having a front and a rear coupled to the base and movable relative to the base between a deployed position and a stowed position;

a first projection engaged between the base and the commode; and a first member adjacent the front and coupled to the projection so that the commode can be disengaged from the base;

wherein the first member includes a pair of arms and a pedal.

2. The lavatory system of claim 1 wherein the first member is configured for pivoting movement and the first projection is configured for translating movement.

3. The lavatory system of claim 2 wherein pivotal movement of the first member causes translating movement of the first projection.

4. The lavatory system of claim 1 wherein the first projection engages an aperture to inhibit movement of the commode.

5. The lavatory system of claim 4 wherein the first projection extends from the commode and the aperture is located on the base.

6. The lavatory system of claim 1 wherein the movement of the commode is pivotal movement.

7. The lavatory system of claim 1 further comprising a second projection extending directly from the commode configured to limit movement of the foot pedal.

8. The lavatory system of claim 1 further comprising a panel pivotally coupled to the base and coupled to the commode by a second member, wherein the commode is movable between the deployed position and the stowed position by operation of the first member so that the first member releases the first projection so that pivoting of the panel causes movement of the commode.

9. The lavatory system of claim 1 wherein the first projection is configured to retain the commode in a stopped position.

10. The lavatory system of claim 9 wherein the first member is operated by a foot of a user and configured to release the first projection so that the commode can be moved from the stopped position.

11. The lavatory system of claim 9 wherein the stopped position is the deployed position.

12. The lavatory system of claim 1 wherein the pair of arms engage the first projection on opposite sides of the commode.

13. In a lavatory system having a commode with a front and a rear coupled to a base and configured to move between a deployed position and a stowed position, and a detent engaged between the commode and the base, the improvement comprising a member coupled to the detent and extending adjacent the front of the commode so that actuation of the member disengages the commode from the base, wherein the member comprises a first arm disposed on a first side of the commode and a second arm disposed on a second side of the commode.

14. An apparatus for a lavatory system having a commode with a front and a rear coupled to a base and configured to pivot between a deployed position and a stowed position, and a detent engaged between the commode and the base, the apparatus comprising a member adjacent the front of the commode and operatively coupled to the detent, the member configured to disengage the commode from the base by actuation of the detent so that the commode can be moved from the deployed position toward the stowed position, wherein the member includes a pedal mounted on a first arm disposed on a first side of the commode and on a second arm disposed on a second side of the commode.

15. The apparatus of claim 14 wherein the member comprises a first arm and a second arm, and further comprising a pin coupled to and oriented generally perpendicular to the detent and wherein ends of the pin engage slots in the first arm and the second arm.

16. The apparatus of claim 14 further comprising a spring configured to bias the detent toward engagement with the base.

* * * * *